United States Patent [19]

Rupp

[11] Patent Number: 5,033,256

[45] Date of Patent: Jul. 23, 1991

[54] BALLOON FILLER

[76] Inventor: Carl A. Rupp, 2382 S. Redwood Rd., Salt Lake City, Utah

[21] Appl. No.: 495,755

[22] Filed: Mar. 19, 1990

[51] Int. Cl.[5] ..... B65B 43/36; B65B 39/02; B65B 39/06; B65B 31/00

[52] U.S. Cl. ..... 53/570; 53/262; 53/385.1; 53/390

[58] Field of Search ..... 53/403, 432, 441, 453, 53/459, 469, 479, 481, 79, 86, 512, 556, 559, 570, 385, 386, 390, 416, 433, 511, 255, 262; 141/10, 51, 59; 206/459

[56] References Cited

U.S. PATENT DOCUMENTS

| | | | |
|---|---|---|---|
| 1,588,040 | 6/1926 | Moore | 53/390 X |
| 2,342,369 | 2/1944 | Ransbottom | 53/262 |
| 2,783,786 | 3/1957 | Carter | 141/59 X |
| 2,815,621 | 12/1957 | Carter | 141/51 X |
| 2,831,510 | 4/1958 | Carter | 53/386 X |
| 2,836,941 | 6/1958 | Hultkrans et al. | 53/411 |
| 2,900,779 | 8/1959 | Baxter et al. | 53/390 X |
| 3,321,103 | 5/1967 | Phillips | 53/390 X |
| 3,350,838 | 11/1967 | Rodrigues | 53/86 |
| 4,546,881 | 10/1985 | Tasma | 206/459 |
| 4,753,060 | 6/1988 | Furukawa | 53/469 X |
| 4,809,483 | 3/1989 | Lovik | 53/390 X |
| 4,809,484 | 3/1989 | Lovik | 53/262 X |
| 4,811,841 | 3/1989 | Domenichiello | 53/390 X |
| 4,878,335 | 11/1989 | Hardy | 53/390 X |
| 4,924,919 | 5/1990 | Oyler | 53/386 X |
| 4,974,393 | 12/1990 | Rich et al. | 53/86 X |

*Primary Examiner*—Horace M. Culver
*Attorney, Agent, or Firm*—M. Reid Russell

[57] ABSTRACT

A balloon filler than includes a two piece evacuation housing arranged to receive a balloon attachment unit that holds a balloon in where the balloon end projects into the evacuation housing and receives a spreader tube whose insertion into the balloon unit attachment opens the balloon mouth and provides a seal between the exterior neck of the balloon and a shoulder of the balloon attachment unit base, a motor and blower are provided to create a sub-atmospheric pressure in the evacuation housing and an object holding tube receiving a balloon on one end and is telescoped onto a pressure tube connected at its opposite end to a pressure chamber receiving pressurized air from the blower.

9 Claims, 3 Drawing Sheets

BALLOON FILLER

BACKGROUND OF THE INVENTION

1. Field of the Invention

This invention relates to apparatus for filling toy balloons.

2. Prior Art

Balloons made of air expansible gas impervious material such as latex rubber, have long been popular as toys and decorative items. The balloons are generally filled with air, water, or lighter than air gasses and occasionally have had balls, figurines, or other solid objects placed inside for amusement or decorative affect. More recently it has become popular to use the balloons as packaging or gift wrapping for objects placed in the balloons.

The placing of objects in the balloon has generally been accomplished by manual stretching of the neck and mouth to open them as an object or objects are placed inside prior to inflation of the balloon.

Balloons have been inflated in the past by mouth or from pressurized air, gas or water source and generally through a nozzle that is inserted into the balloon mouth and neck. Some very expensive devices have also been proposed to expand a balloon before insertion of objects therein.

OBJECTS OF THE INVENTION

Principal objects of the present invention are to provide apparatus for holding the mouth and neck of a toy balloon open while the balloon is expanded, maintaining the open condition while objects are placed in the balloon and closing the neck of the balloon while maintaining it in an expanded condition.

Other objects are to provide a low cost balloon filler apparatus requiring little maintenance and upkeep, that can be operated by persons having little previous training in its use.

Still other objects are to provide a balloon filler apparatus that can be used to simultaneously fill a plurality of balloons, if desired.

FEATURES OF THE INVENTION

Principal features of the invention include an evacuation housing and a pressure tube. A motor driven fan is used to provide a sub-atmospheric pressure within the evacuation housing and to provide pressure greater than atmospheric to the pressure tube.

An attachment unit has a plurality of flexible pivoting flaps with tips that form an attachment ring for receiving the mouth of a balloon and serves with the balloon as a seal for the evacuation housing during expansion of the balloon within the housing. A spreader tube is inserted into the attachment unit to spread the flaps and open the balloon mouth, whereafter and objects to be placed in the balloon are inserted through the spreader tube and balloon mouth.

The pressure tube has an object holding tube telescoped thereon. The object holding tube has a perforated plate that covers the discharge end of the pressure tube and is flared at its opposite end to review the mouth of a balloon. Objects to be placed in the balloon are first placed in the object holding tube, which is then mounted on the discharge end of the pressure tube. The balloon mouth is placed on the flared end of the object holding tube and pressurized air is applied through the pressure tube so as to both inflate the balloon and blow the object or objects placed in the object holding tube into the balloon.

After filling, a balloon is temporarily sealed by grasping it at the neck and is then more permanently sealed by tieing off that neck or using a clamping device thereon.

Other objects and features of the invention will become apparent from the following detailed description and drawing disclosing what are presently contemplated as being the best modes of the invention.

THE DRAWINGS

In the drawings,

FIG. 1 is an exploded perspective view of the balloon filler of the invention;

FIG. 2, a vertical sectional view taken along the line 2—2 of FIG. 1 and showing the spreader tube ready for insertion;

FIG. 3, a fragmentary view like that of FIG. 2, and showing the spreader tube partially inserted;

FIG. 4, a top plan view, taken on the line 4—4 of FIG. 3;

FIG. 5, a view like that of FIG. 2, but showing the spreader tube fully inserted;

FIG. 6, a vertical sectional view, taken on the line 6—6 of FIG. 1, and showing an uninflated balloon; and FIG. 7, a view like that of FIG. 6, showing a fully telescoped object holding tube and filled balloon.

DETAILED DESCRIPTION OF THE INVENTION

Figure 1:
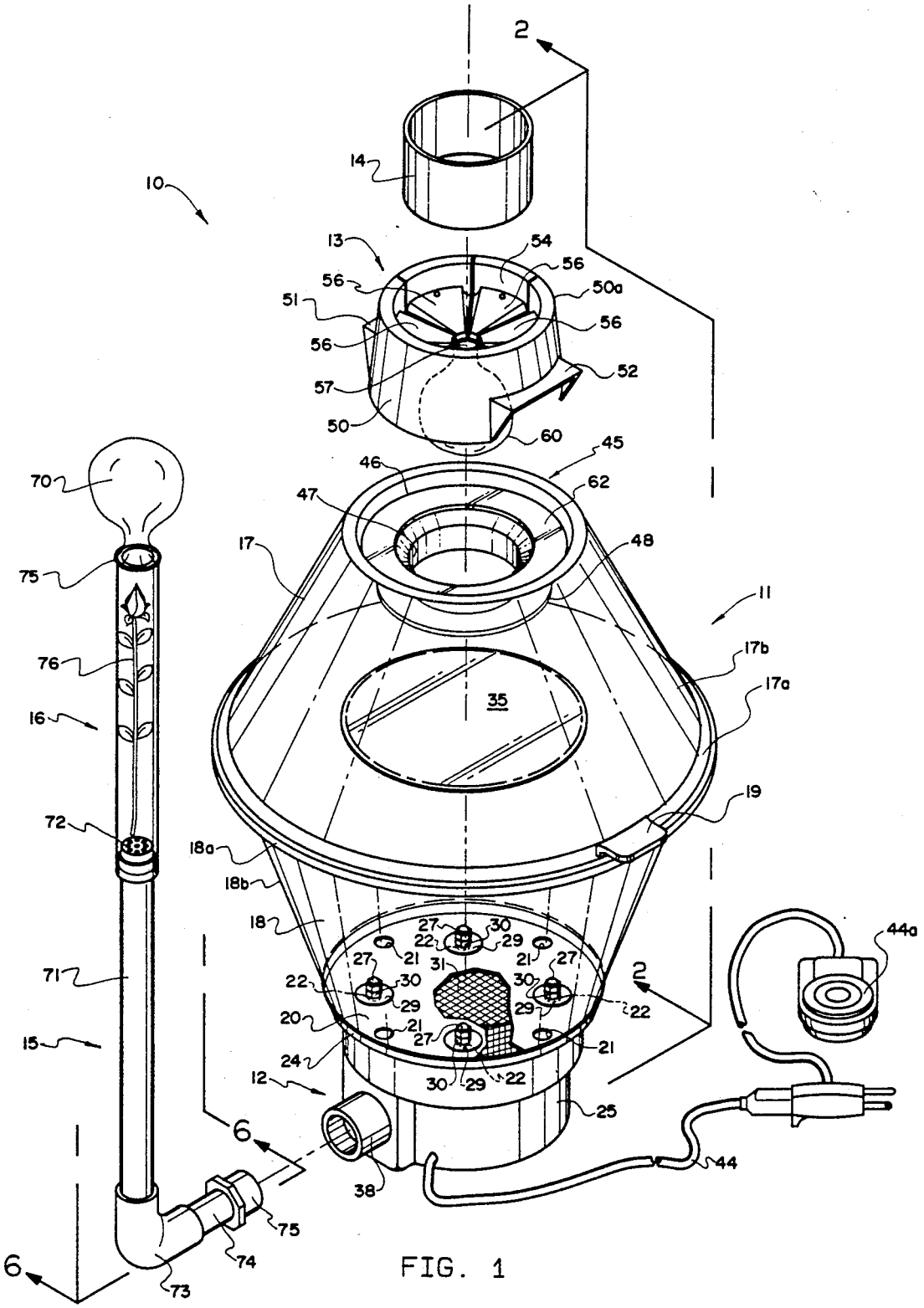

Referring now to the drawings:

In the illustrated preferred embodiment, the balloon filler of the invention, shown generally at 10, includes an evacuation housing 11, a motor housing 12, a balloon attachment unit 13, a spreader tube 14, a pressure tube 15, and an object holding tube 16.

The evacuation housing includes a transparent upper housing section 17 and a transparent lower housing section 18. Each of the upper and lower housing sections is in the form of a hollow truncated cone. A flange **17*a* around a ring-shaped base 17*b* of the upper housing section, fits tightly against and within a flange 18*a* formed around a base 18*b* of the lower housing section 18** releasable coupling the housing sections together.

A handle 19 is used to separate the upper housing section 17 from the lower housing section 18, as will be further explained.

Figure 2:
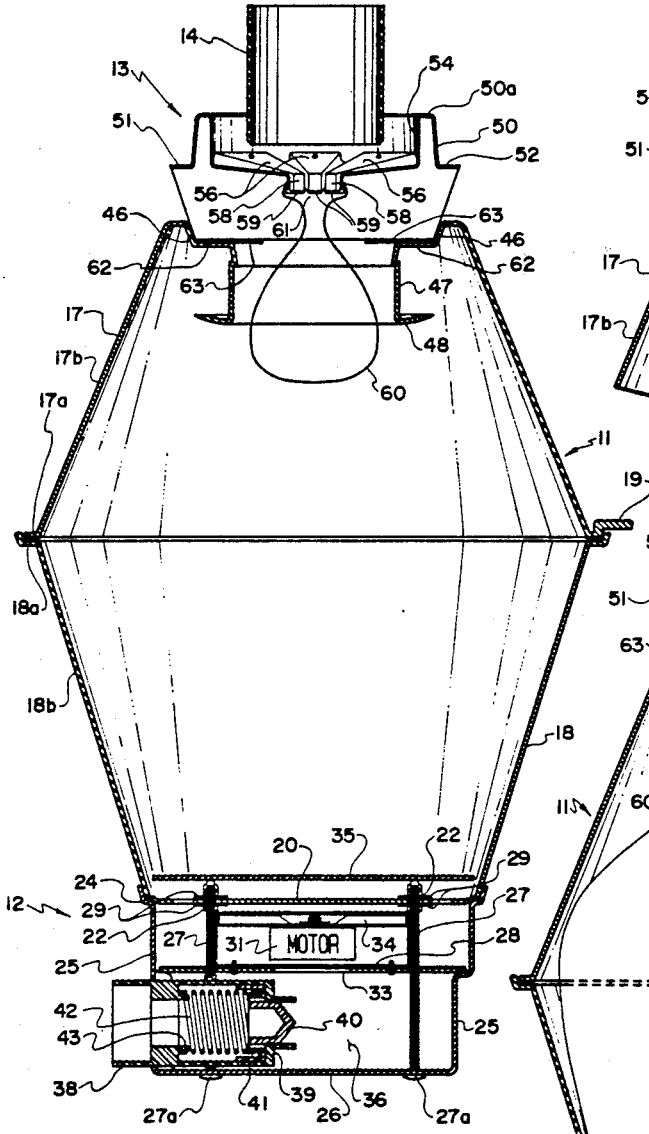

The lower housing section 18 has an end cover 20 formed at the end thereof opposite base **18*b*, with a ring of air ports 21 through the end cover and another ring of bolt holes 22 therethrough, shown best in FIG. 2**.

Figure 3:
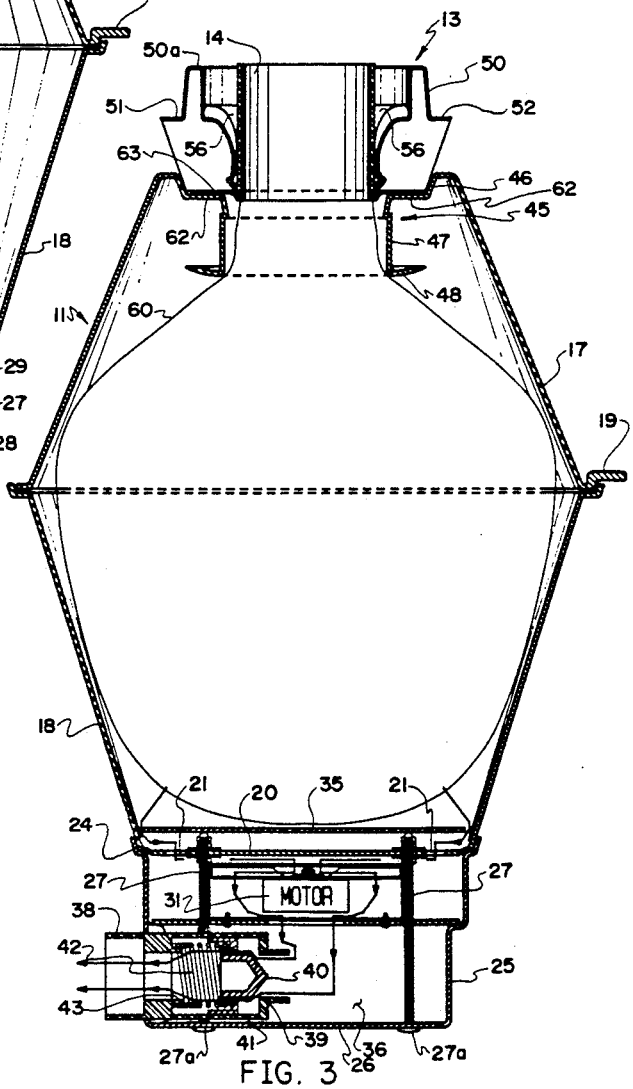

The motor housing 12 has an exterior flange 24, shown in FIGS. 1, 2 and 3, formed in an outer wall 25 of the housing, and that wall is closed by a bottom plate 26. Bolts 27 extend through the bottom plate 26 and through a divider plate 28 in the housing 12, with grommets 29 fitted in the holes 22 as shown in FIG. 2. Nuts 30 are threaded onto the ends of the bolts thereby locking the motor housing to the lower housing section 18, the heads **27*a* of bolts 27 also serving as feet for the balloon filler 10**.

A motor 31 shown best in FIGS. 2 and 3, mounted by bolts 27 in the motor housing 12 above a hole 33 through the divider plate 28 and a fan blade 34 is fixed to and driven by the output shaft of that motor. The motor 31 to pull air from inside the evacuation housing 11 around and through a foam pad 35, that is shown in FIG. 1 exploded off from but in practice, as shown in FIGS. 2 and 3, rests on the ends of bolts 27, through the air ports 21, the hole 33, and into a lower chamber 36 of the housing 12 that is formed beneath divider plate 28, thereby pressurizing the chamber to sub-atmospheric.

A discharge tube 38 is shown best in FIGS. 1, 2 and 3, extending through the outer wall 25 that has a valve seat 39, as shown best in FIGS. 2 and 3, formed on the end thereof that projects into housing 12. A check valve head 40 having a cup-shaped surrounding ring 41 is arranged to slide within the tube 38 and receives one end of a spring 42 fitted thereto. The other end of which spring 42 is telescoped over a sleeve 43 that is fixed to the inside of tube 38. So arranged, the spring 42 biases the check valve head 40 into sealing engagement with valve seat 39, which biasing is overcome by operation of motor 31 turning fan blade 34.

A power cord 44 is connected to the motor 31, extending through motor housing 12 and a foot operated switch 44*a*, is provided that connects into the chord for controlling on-off operation of the motor.

The end of upper housing section 17, opposite flange 17*a*, is open to receive a wall 45 fitted to extend into the upper housing section that includes an upper shoulder 46 downwardly wherefrom extends a tubular sleeve 47 having an outwardly flared lower rim 48.

The balloon attachment unit 13 includes a rigid outer skirt 50 with handles 51 and 52 on opposite sides thereof. The skirt 50 is adapted to fit into the upper housing section 17, wall 45, to rest on the shoulder 46, with the handles 51 and 52 then protruding from the upper housing section.

A diaphragm 54 having one end fixed to a rim 50*a* of skirt 50, is shown best in FIG. 1, extending as a sleeve into a cylinder 55 that is formed within skirt 50. The diaphragm, consists of a solid upper wall whereto are pivotally coupled along individual top edges, a plurality of flexible, side-by-side flexible wedge-shaped flaps 56 that each slope downwardly reach into a center area 57 of the cylinder where at the arc curved downwardly to the vertical at 58 and outwardly, forming a hook 59 on each the flexible flap ends opposite to their pivot coupling end.

The spreader tube 14 is essentially an open cylinder having an outside diameter that will telescope into the diaphragm 54, the round end thereof engaging and spreading the wedge shaped flaps 56, as will be further explained later herein.

In use, the upper housing section 17 is fitted on the lower housing section 18, with the motor housing 12 secured to the lower housing section.

Figure 5:
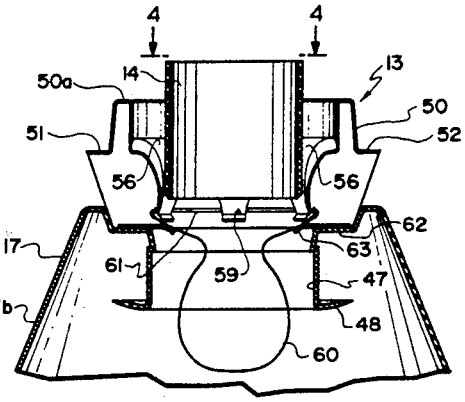
Figure 4:
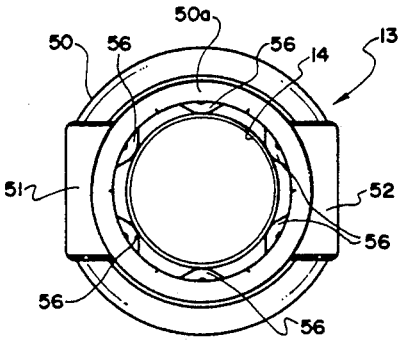

As shown best in FIGS. 4 and 5, a balloon 60 to be filled is attached to the balloon attachment unit 13 by pulling the mouth 61 of the balloon over the hook ends 59 of the wedge shaped flaps 56. The balloon attachment unit 13 is then inserted into the upper housing section 17, resting on shoulder 46, as shown in FIG. 4, with the balloon hanging therefrom.

Spreader tube 14 is inserted into the balloon attachment unit 13 to open the wedge shaped flaps 56 and thereby open the mouth 61 of the balloon 60. Shown in FIGS. 2 and 3, the spreader tube is inserted until it has spread the wedge shaped flaps sufficiently to wherein the balloon wall that faces the outer surface of hook ends 59 engages and forms a seal against a shoulder seal 62 that, as shown best in FIG. 3, flexes at its inner edge 63 to conform to the hook ends 59, prohibiting air from passing between the balloon neck and seal edge 63, as shown best in FIG. 3, with the tube 14 fully inserted into the balloon attachment unit 13.

The foot switch 44*a* is operated to start motor 31, whereafter air is pulled from the evacuation housing 11, and as previously described, the chamber 36 is pressurized. When a sufficient pressure has been achieved in the chamber 36, valve head 40 will overcome the biasing of spring 42 and move off the seat 39, as shown in FIG. 3, thereby opening chamber 36 to allow pressurized air to be discharged through discharge tube 38.

The pressure differential inside and outside the balloon, caused by actuation of motor 31, provides a atmospheric state within evacuation housing 11. The air in the balloon that is at atmospheric pressure expands the balloon inside the evacuation housing 11 to limits determined by the interior size of the upper and lower housing sections, as shown in FIG. 3, which housing sections can further include spacers, not shown, as required, altering the housing volume controlling the balloon expansion. The perforated plate 35 keeps the balloon from being pulled into holes 21.

While the balloon is in its expanded condition, with the mouth thereof held open by the spreader tube 14, as shown in FIG. 3, desired objects such as toys, can be easily placed inside the balloon.

Once the balloon is fully open, it seals around its neck against the tubular sleeve 47 and outwardly flared lower rim 48. A seal is thereby formed, that allows a release of the seal at shoulder seal edge 63 as shown in FIG. 3. The spreader tube 14 can then be fitted in the balloon neck collapsing with the pivoting wedge-shaped flaps 56 of the balloon attachment unit 13 to the attitude of FIG. 2, where the attachment unit can be lifted and turned to twist the balloon neck to were it seals. The spreader tube 14 can then be removed and the balloon neck removed from the attachment unit 13 and tied or clipped off. Thereafter, handle 19 is used to separate the upper housing section 17 from lower housing section 18 and to release the balloon that is removed therefrom.

Figure 6:
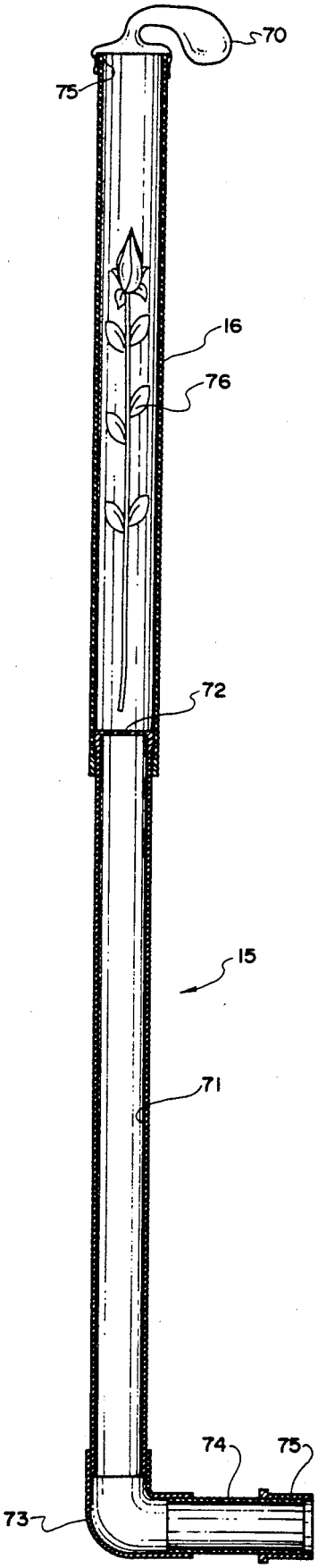
Figure 7:
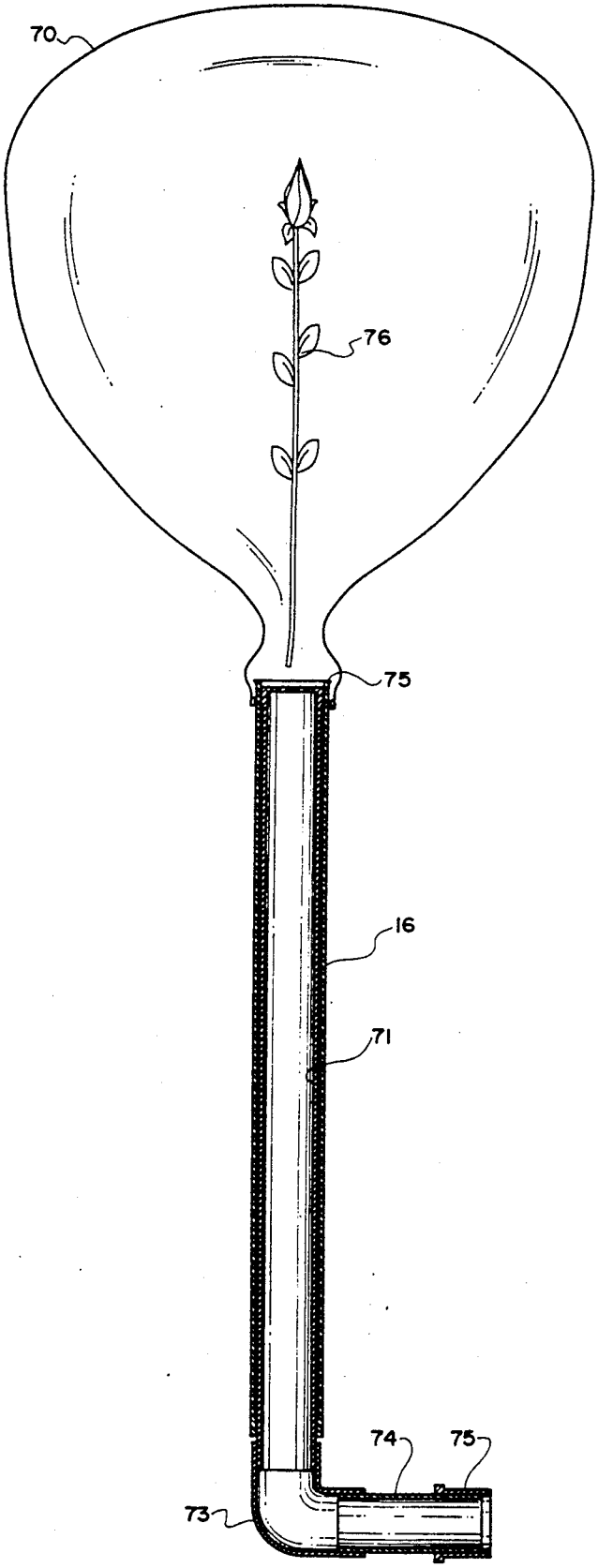

If desired, the pressurized air discharged through discharge tube 38 may be used to place objects in another balloon 70 shown in FIGS. 1, 6 and 7. For this purpose the pressure tube 15, including a standpipe 71 having a perforated plate 72 formed across the upper end thereof, an elbow 73, a connecting pipe 74 with a flanged sleeve coupling 75 that telescopes into the discharge tube.

As shown best in FIG. 6, the object holding tube 16 is preferably transparent and is telescoped over the end of the standpipe 71. Objects to be placed in the balloon 70 are placed in the tube 16 and the mouth of balloon 70 is stretched over a flared end 75 of tube 16.

Pressurized air evacuated from chamber 36, as set out above, is directed through discharge tube 38 into pressure tube 15 may blow the objects, such as the artificial flower 76, as shown best in FIG. 7, into the balloon 70 as it expands it. With the balloon fully expanded, the object holding tube 16 is moved along the pressure tube telescoping the pressure tube 15 into the object holding tube fully inserting the object into the filled balloon. The perforated plate 72 both directs pressure into the object holding tube and maintains the positioning of the object or objects, such as the flower 76 as the balloon is passed thereover. The user holds the balloon on the object holding tube during expansion, and when the balloon is sufficiently enlarged twists the balloon neck and removes it from tube 16, whereafter a permanent tie or clip can be installed to the balloon neck.

Although a preferred form of my invention has been herein disclosed, it is to be understood that the present disclosure is by way of example, and that variations are possible without departing from the subject matter coming within the scope of the following claims and a reasonable equivalency thereof, which subject matter I regard as my invention.

I claim:

1. A balloon filler comprising, an evacuation housing consisting of upper and lower sections, for releasable coupling in sealing engagement along common edges at a middle of said evacuation housing and having a combined internal volume for accommodating a filled balloon; means for providing full access to the interior of said evacuation housing; means to hold a balloon in position where the balloons end thereof projects into the interior of said evacuation housing through an opening in said evacuation housing; means to both open the mouth of a balloon secured to the means to hold the balloon and to seal the opening in the said evacuation housing around the open balloon neck; and means to provide a sub-atmospheric pressure in the evacuation housing.

2. A balloon filler as in claim 1, wherein the evacuation housing upper and lower sections are each formed as a truncated cone, the base of each having a greatest diameter, the lower housing section rotated to receive in sealing engagement the base of said upper housing section.

3. A balloon filler as in claim 2, further including handle means fixed to the upper housing section, adjacent the base thereof.

4. A balloon filler as in claim 3, wherein the upper housing section includes a sleeve defining an opening through the truncated end thereof and into the upper housing; and the means to hold a balloon in position where the balloons end projects into the interior of the evacuation housing comprises a balloon attachment unit with a cylindrical body for telescoping into said opening through the truncated end of the upper housing, a diaphragm in the cylindrical body where around a plurality of flexible flaps are pivotally connected to extend into the cylindrical body, and said flexible flaps include outwardly projecting hook means on the ends thereof to receive the mouth of a balloon.

5. A balloon filler as in claim 4, wherein the means to open the mouth of a balloon comprises a spreader tube for telescoping into the balloon attachment unit so as to spread the flexible flaps, thereby opening the mouth of a balloon mounted to the hooks on the flexible flap ends and to move the neck of the balloon into sealing engagement with a shoulder at a base of said balloon attachment unit that defines an opening through the truncated end and into the upper housing.

6. A balloon filler as in claim 5, wherein the means to provide a sub-atmospheric pressure in the evacuation housing comprises, means defining an opening through the truncated end of the lower evacuation housing; and a motor housing fixed to the truncated end of the lower housing and having a motor therein containing a blower driven by motor for pulling air from the evacuation housing through the opening formed through said truncated end of said lower evacuation housing, a pressure chamber receiving pressurized air from said blower, a discharge outlet through said motor housing and a check valve in said discharge outlet arranged to open when a predetermined air pressure is achieved in said pressure chamber.

7. A balloon filler as in claim 6, further including a standpipe having one end connected to the discharge outlet and a screen cover over the other end; and an article holding tube having one end telescoped over the end of the standpipe wherever said screen is positioned, and a flared opposite end arranged to receive the mouth of a balloon thereover.

8. A balloon filler as in claim 2, wherein the means to open the mouth of a balloon comprises a spreader tube for telescoping into a balloon attachment unit so as to spread flexible flaps thereof opening the mouth of a balloon attached over hook means on the flexible flaps and to move the neck of the balloon into sealing engagement with a shoulder at the base of said balloon attachment unit that defines an opening through the truncated end and into the upper housing.

9. A balloon filler as in claim 2, wherein the means to provide a sub-atmospheric pressure in the evacuation housing comprises means defining an opening through the truncated end of the lower evacuation housing; and a motor housing fixed to the truncated end of said lower evacuation housing and having a motor therein and a blower driven by said motor for pulling air from the evacuation housing through the truncated end of said lower evacuation housing, a pressure chamber receiving pressurized air from said blower, a discharge outlet through said motor housing from said discharge outlet, and a check valve in said discharge outlet that is arranged to open when a predetermined air pressure is present in the pressure chamber.

* * * * *